United States Patent [19]

Nnadi et al.

[11] 4,025,452

[45] May 24, 1977

[54] ETHER-LINKED POLYMERS AND COMPOSITIONS CONTAINING THEM

[75] Inventors: John C. Nnadi, Glassboro; Israel Joel Heilweil, Princeton, both of N.J.

[73] Assignee: Mobil Oil Corporation, New York, N.Y.

[22] Filed: May 12, 1975

[21] Appl. No.: 576,935

[52] U.S. Cl. ..... 252/51.5 A; 252/51.5 R

[51] Int. Cl.[2] ..... C10M 1/32; C10M 3/26; C10M 5/20; C10M 7/30

[58] Field of Search ..... 252/47.5, 51.5 R, 51.5 A

[56] References Cited

UNITED STATES PATENTS

| | | | |
|---|---|---|---|
| 3,156,690 | 11/1964 | Dexter et al. | 252/47.5 |
| 3,206,407 | 9/1965 | Lutwack | 252/47.5 |
| 3,250,772 | 5/1966 | Dexter et al. | 252/47.5 |
| 3,296,135 | 1/1967 | Cupper et al. | 252/47.5 |
| 3,309,345 | 3/1967 | Lutwack | 252/47.5 |
| 3,642,630 | 2/1972 | MacPhail et al. | 252/47.5 |
| 3,700,666 | 10/1972 | Robin et al. | 252/47.5 |
| 3,709,883 | 1/1973 | Dexter et al. | 252/47.5 |

*Primary Examiner*—Delbert E. Gantz
*Assistant Examiner*—I. Vaughn
*Attorney, Agent, or Firm*—Charles A. Huggett; Raymond W. Barclay

[57] ABSTRACT

As a new class of multifunctional additives, for imparting dispersancy and viscosity improving properties to lubricant compositions, ether-linked polymers having the structure:

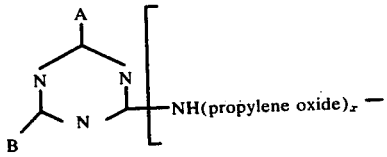

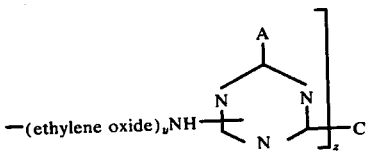

in which:

A and B may be the same, i.e., B=A or different substituents and are individually selected from the group consisting of hydrogen, alkyl, alkenyl, aryl, hydroxy and amino derivatives thereof, carboxy, alkyl carboxy, hydroxy, phosphono, phosphato, sulfonato, mercapto and a nitrogen-containing group having a chain length from 1 to 500 carbon atoms, $x$, $y$ and $z$ are zero or a whole number and at least one of $x$ and $y$ is a whole number, and C is

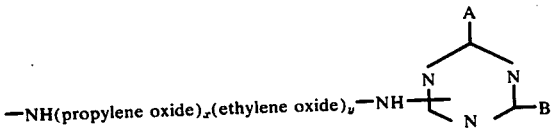

10 Claims, No Drawings

ETHER-LINKED POLYMERS AND COMPOSITIONS CONTAINING THEM

BACKGROUND OF THE INVENTION

1. Field of the Invention

This invention relates to novel additives for imparting dispersancy and viscosity improving properties to lubricant compositions. More particularly, the invention relates to novel additives in the form of ether-linked polymers, for imparting such dispersancy and viscosity improving properties to lubricant compositions, particularly lubricating oils and greases.

2. Description of the Prior Art

In U.S. Pat. Nos. 3,172,892 and 3,219,666 there are disclosed additives derived from succinic acid compounds and polyamines. U.S. Pat. No. 3,024,195 discloses lubricating oil compositions containing alkenylsuccinimide N-alkylpiperazine. U.S. Pat. No. 3,200,076 discloses compounds of an alkenylsuccinic compound and a polypiperazinyl alkylene. U.S. Pat. No. 3,455,386 discloses polypropenylsuccinimide derivatives. U.S. Pat. No. 3,368,972 discloses the preparation of Mannich bases. The compounds disclosed in these patents, however, do not contain interlinked molecules, nor do they disclose ether-linked polymers, as specifically employed in the lubricant compositions of the present invention, as more fully hereinafter disclosed.

SUMMARY OF THE INVENTION

A novel class of multifunctional additives for imparting dispersancy and viscosity improving properties to lubricant compositions, particularly in the form of oils or lubricating viscosity and greases, are provided, in the form of ether-linked polymers having the following structure:

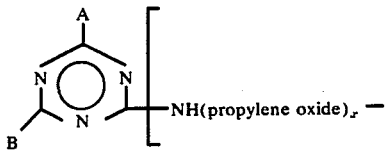

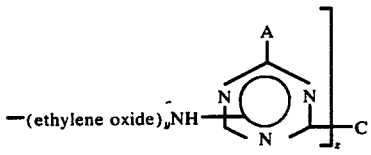

in which:

A and B may be the same, i.e. B=A or different substituents and are individually selected from the group consisting of hydrogen, alkyl, alkenyl, aryl, hydroxy and amino derivatives thereof, carboxy, alkyl carboxy, hydroxy, phosphono, phosphato, sulfonato, mercapto and a nitrogen-containing group having a chain length from 1 to 500 carbon atoms, $x$, $y$ and $z$ are zero or a whole number and at least one of $x$ and $y$ is a whole number, and C is

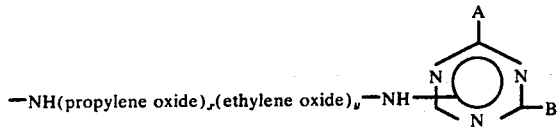

These additives may be employed in the lubricant compositions in any amount sufficient to impart the desired dispersancy and viscosity improving properties. For many applications, the dispersancy and viscosity improver is employed in an amount from about 0.001% to about 10%, by weight, and preferably in an amount from about 0.5% to about 5% by weight. In the above-described structural formula, the organic groups of A, B and C for most applications, contain from about 1 to about 500 carbon atoms, and preferably from about 1 to about 100 carbon atoms. Collectively, the nitrogen-containing groups may include amino, anilino, imidazolines, Mannich bases, pyrrolidines, pyrrolidones, succinimide amino, lactam amino and the like.

In general, the above-described novel ether-linked polymers of the present invention are obtained by reacting:

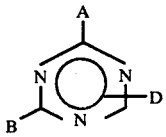

(I)

and

NHRR'NHR'' (II)

in which:

R and R'' are hydrogen, alkyl, alkenyl, aryl, alkylamine, arylamine or acyl. R' is a polyether, such as polyethylene oxide, polypropylene oxide, polyethylene oxide-polypropylene oxide, polyethoxylated and/or polypropoxylated alcohols, amines, aminophenols, amino naphthols and amino acids. A and B are described with respect to the aforementioned structural formula and D is a halogen. The reaction between (I) and (II) is, in general, carried out at a temperature from about 80° to about 250° C, and preferably about 100° to about 200° C. The molar ratio of reactants (I) and (II) can be varied to yield monomers, dimers, trimers, and higher polymers. The molecular weight of the polyether can vary from about 74 to about 2,000,000.

DESCRIPTION OF SPECIFIC EMBODIMENTS

The following examples and comparative data will serve to illustrate the improvements in dispersancy and viscosity improving characteristics imparted to lubricant compositions by the novel ether-linked polymers of the present invention.

EXAMPLE 1

1.6 g. 2-amino-4,6-dichloropyrimidine and 20 g. amine terminated polypropylene oxide-polyethylene oxide (mol. wt. 2000) are mixed in 100 g. of process oil and heated to 140°–180° C for 1 hour. To this mixture is added 50 g. of bis-succinimide, designated by the aforementioned letter A, and having a polybutene group of 900 mol. wt. and obtained from tetraethylenepentamine, with heating continued at 170°–190° C for a period of 18 hours. The reaction product is washed with 10% NaOH solution. After removing the wash solvents under reduced pressure, the yield of filtered product is 160 g. The IR spectra of the product showed the presence of polyether groups and GPC (Gel Permeation Chromotography) showed considerable increase in molecular weight. Found, %N 1.46; %Cl 0.34. The structure of this compound is as follows:

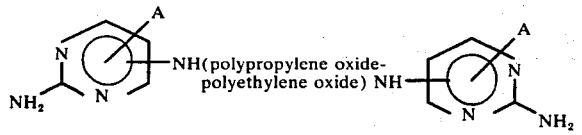

EXAMPLE 2

The triazine analog of Example 1 is prepared by reacting a mixture of 4.5 g. cyanuric chloride, 20 g. of the polyether, 100 g. bis-succinimide, represented by the letter A, having a polybutene group of 600 mol. wt. and obtained from tetraethylenepentamine and 100 g. process oil as described in Example 1. The yield of product is 200. Found, 1.68% N; 0.28% Cl. The structure for this compound is as follows:

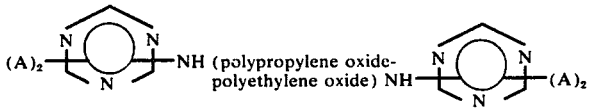

EXAMPLE 3

From 7.2 g. cyanuric chloride, 200 g. bis-succinimide of Example 1, designated by the letter A, 60 g. of the polyether, and 60 g. of process oil reacted as in Example 1, 278 g. product (%N, 1.86; %Cl, 0.07) is obtained. The structure of this compound is as follows:

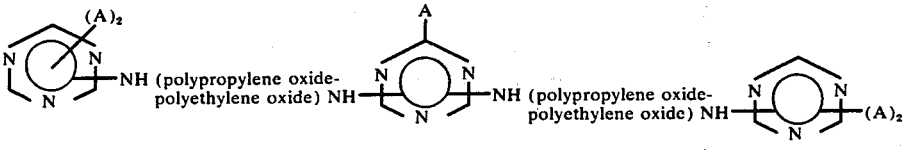

EXAMPLE 4

From 3.6 g. cyanuric chloride, 140 g. bis-succinimide of Example 1, designated by the letter A, 30 g. of the polyether and 60 g. process oil, reacted as in Example 1, a product is obtained in more than 90% yield. Found: 1.61% N, 0.03% Cl. This product has the following structure:

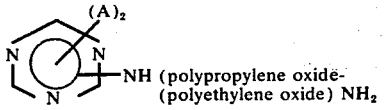

EXAMPLE 5

From 1.8 g. cyanuric chloride, 30 g. of the polyether, 36 g. of bis-succinimide (A) of Example 1 and 30 g. process oil reacted as in Example 1, a product is obtained in greater than 90% yield. Found: 1.39% N; 0.04% Cl. The product has the following structure:

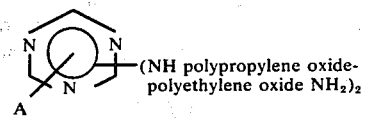

EXAMPLE 6

From 1120 g. bis-succinimide, having a polybutene group of 1350 mol. wt., represented by the letter A, and obtained from tetraethylenepentamine, 130 g. process oil, 30 g. cyanuric chloride and 160 g. of the polyether reacted as in Example 1, 1200 g. of product is obtained. This product has the following structure:

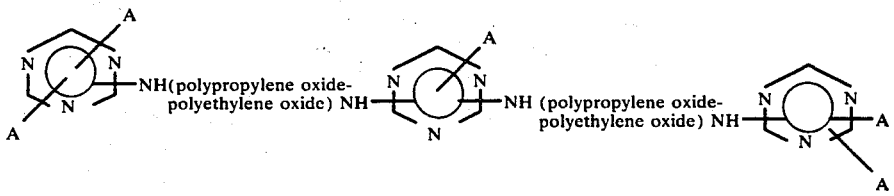

Found: 1.65% N, 0.01% Cl, 0.33% Na.

EXAMPLE 7

The reaction conditions of Example 1 were used to react 1.8 g. cyanuric chloride, 23 g. bis-alkenylsuccinimide (obtained from polybutene mol. wt. 550 and tetraethylenepentamine) 60 g. process oil and 15 g. of the polyether of Example 1 and 75 g. product was obtained. Found: 1.85% N; 0.01% Cl.

EXAMPLE 8

The procedure of Example 7 is repeated except that 3 g. polypropylene oxide having a molecular weight of 400 is employed.

EXAMPLE 9

The procedure of Example 7 is repeated except that the chlorinated heteroaromatic is a 50/50 mixture of cyanuric chloride and 2,4,6-trichloropyrimidine.

EXAMPLE 10

The procedure of Example 7 is repeated except that the polyether is amine terminated propolylated glycerol having a molecular weight of 600.

EXAMPLE 11

The procedure of Example 1 is repeated except that the polyethylene oxide-polypropylene oxide has a molecular weight of about 1000.

EXAMPLE 12

The procedure of Example 1 is repeated except that 2,6-dichloropyridine is used as the chlorinated heteroaromatic compound. The reaction temperature is 190°–200° C and the conversion to polymeric materials (by GPC analysis) is less than obtained in Example 1.

EXAMPLE 13

The procedure of Example 1 is repeated except that the succinimide employed is obtained from polybutylsuccinimide, having a polybutene group of 2700 mol. wt. and tetraethylenepentamine.

EXAMPLE 14

The procedure of Example 1 is repeated except that alkenyl pyrrolidine (made by completely reducing the C=O groups of the succinimide of Example 1) is employed in place of the succinimide.

EXAMPLE 15

The procedure of Example 1 is repeated except that a Mannich base dispersant (made from triethylene tetramine, $CH_2O$ and alkyl phenol of 800 mol. wt.) is employed in place of the succinimide.

EXAMPLE 16

The procedure of Example 15 is repeated except that the Mannich base dispersant has alkyl phenol groups of 2000 molecular weight.

Some of the products of the foregoing examples, when subjected to the standard ASTM Kinematic Viscosity and Viscosity Index tests D2270 are found to produce the results shown in the following Table I. The base oil employed in these examples comprised 150 second solvent refined paraffinic stock.

TABLE I

| Ex. | Description | Wt. % Active Ingredient | ASTM Kinematic Viscosity (CS) 100° F | 200° F | Viscosity Index |
|---|---|---|---|---|---|
| 1 | Base oil | — | 31.08 | 5.20 | 107 |
| 2 | Example 1 | 3 | 53.23 | 8.38 | 130 |
| 3 | Example 2 | 6 | 85.68 | 12.62 | 134 |
| 4 | Example 3 | 2 | 46.95 | 7.3 | 125 |
| 5 | Example 4 | 4 | 77.12 | 10.71 | 126 |
| | | 6 | 127.4 | 16.13 | 127 |
| 6 | Example 5 | 6 | 52.53 | 8.49 | 134 |
| 7 | Example 6 | 2 | 34.35 | 5.45 | 116 |
| | | 5 | 38.66 | 6.15 | 115 |

It will be apparent from the foregoing table that the presence of the ether-linked polymers of the present invention impart marked improvement in lubricant compositions with respect to kinematic viscosity and viscosity index.

Some of the products of the foregoing examples, when subjected to the standard Tapping Efficiency Test, as disclosed in U.S. Pat. No. 3,121,689, are found to produce the results shown in the following Table II.

TABLE II

| Example | Description | Tapping Efficiency |
|---|---|---|
| 1 | Base Oil | 87 |
| 2 | Base Oil + 3% example 1 | 107 |
| 3 | Base Oil + 3% example 2 | 100 |
| 4 | Base Oil + 3% example 5 | 116 |

The base oil employed in the foregoing test comprised a solvent refined 150 second paraffinic stock containing 0.68% sulfur and 0.3% sulfurized lard oil. It will be apparent from the foregoing table that the tapping efficiency of lubricant compositions is markedly improved by the presence of the ether-linked polymers of the present invention.

While this invention has been described with reference to preferred compositions and components therefor, it will be understood, by those skilled in the art that departure from preferred embodiments can be effectively made and are within the scope of the specification.

We claim:

1. A lubricant composition containing a dispersancy and viscosity improving amount of a compound having the structure:

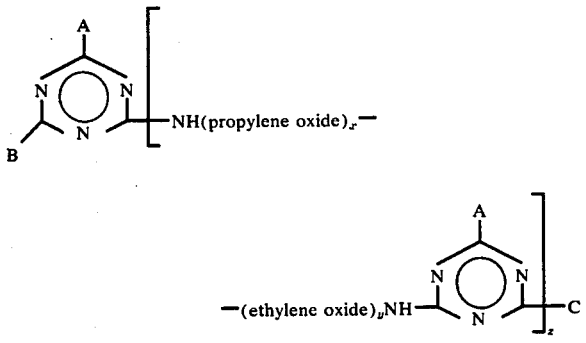

in which:

A and B may be the same or different substitutents and are individually selected from the group consisting of: hydrogen, alkyl having a chain length from 1 to 100 carbon atoms, alkenyl having a chain length from 1 to 100 carbon atoms, hydroxy, amino, anilino, imidazolines, mannich bases, pyrrolidines, pyrrolidones, succinimide amino, and lactam amino; $x$, $y$, and $z$ are zero or a whole number and at least one of $x$ and $y$ is a whole number, and C is

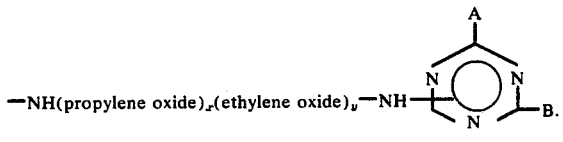

2. A lubricant composition as defined in claim 1 in which the dispersancy and viscosity improving compound has the formula:

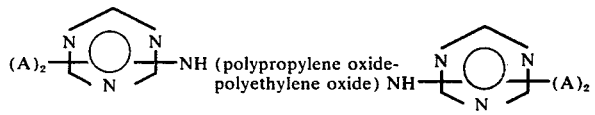

3. A lubricant composition as defined in claim 1 in which the dispersancy and viscosity improving compound has the formula:

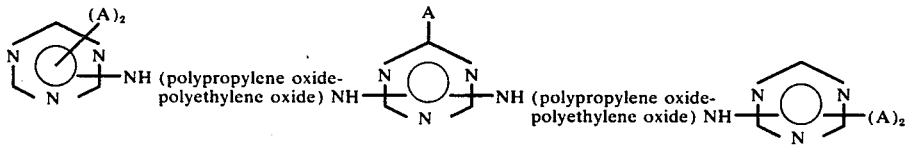

4. A lubricant composition as defined in claim 1 wherein said dispersancy and viscosity improving compound is present in an amount from about 0.001% to about 10% by weight.

5. A lubricant composition as defined in claim 1 wherein said dispersancy and viscosity improving compound is present in an amount from about 0.5% to about 5%, by weight.

6. A lubricant composition as defined in claim 1 wherein said lubricant comprises an oil of lubricating viscosity.

7. A lubricant composition as defined in claim 2 wherein A is bis-succinimide obtained from tetraethylenepentamine and having a polyisobutene group of 600 molecular weight.

8. A lubricant composition as defined in claim 3 wherein A is bis-succinimide obtained from tetraethylenepentamine and having a polybutene group of 900 molecular weight.

9. A lubricant composition as defined in claim 1 wherein said dispersancy and viscosity improving compound has the formula:

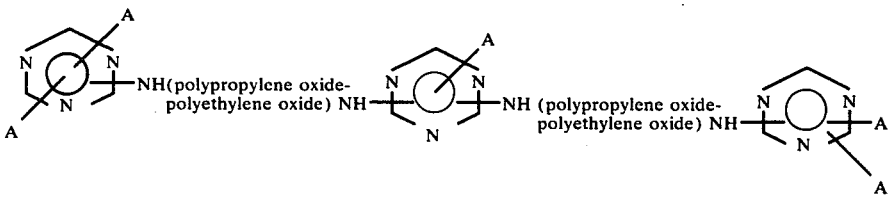

where A is bis-succinimide obtained from tetraethylenepentamine and having a polybutene group of 1350 molecular weight.

10. A lubricant composition as defined in claim 1 wherein the succinimide amino is bis-alkenylsuccinimide obtained from tetraethylenepentamine and having a polybutene group of 550 molecular weight.

* * * * *